United States Patent [19]

Altman et al.

[11] 3,991,952

[45] Nov. 16, 1976

[54] SHIM STRIP INSERTER FOR SLITTING AND RE-ROLLING MACHINE

[75] Inventors: Hugo Altman; Patrick L. Ryan, both of Minneapolis, Minn.

[73] Assignee: Fullerton Metals Co., Northbrook, Ill.

[22] Filed: June 30, 1975

[21] Appl. No.: 591,655

[52] U.S. Cl. ..... 242/56.9; 242/78.1

[51] Int. Cl.[2] ..... B65H 19/04

[58] Field of Search ..... 242/56.2, 56.9, 56.7, 242/56.9, 56 R, 80, 67.3, 78.1, 68.4, 67.2

[56] References Cited

UNITED STATES PATENTS

| | | | |
|---|---|---|---|
| 2,935,273 | 5/1960 | Hoeffgen | 242/56.9 X |
| 3,406,924 | 10/1968 | Bruns | 242/56.9 X |
| 3,871,594 | 3/1975 | O'Neil | 242/56.9 |

*Primary Examiner*—Edward J. McCarthy

*Attorney, Agent, or Firm*—Leydig, Voit, Osann, Mayer & Holt, Ltd.

[57] ABSTRACT

A shim inserter for a slitting and re-rolling machine which includes a feeding assembly having a hopper for storing a supply of shim strips with motor driven means for feeding strips one by one through a guide into the re-roll nip. Means are provided for changing the vertical angle of the guide to orient the same in the direction of the nip. A carriage is provided for mounting the feeding assembly, the carriage being transversely positionable in alinement with a loose ribbon resulting from the slitting operation.

12 Claims, 11 Drawing Figures

SERVO

SUPPLY LINE

SHIM STRIP INSERTER FOR SLITTING AND RE-ROLLING MACHINE

Metal supply houses customarily slit wide coils of steel or other metal into ribbons of predetermined width as specified by a customer. Such ribbons, suitably re-rolled, are ordered in a width suitable for making workpieces of predetermined size as, for example, by a punching operation.

In the usual set-up for slitting and re-rolling, the ribbons are re-rolled upon a common take-up mandrel. One problem is that the original roll of material, as received, is slightly crowned, that is, thicker at the middle than at the edges because of the slight bowing of the rollers employed in manufacture. Thus the re-rolled ribbons in the end positions, being composed of thinner material, do not wind tight and the re-rolled coils, consisting of loose convolutions, tend to come apart and are thus difficult to handle.

To prevent this it has been customary for the operator of a slitting and re-rolling machine to insert strips of cardboard into the loose rolls while the machine is in operation. This is a hazardous undertaking requiring exercise of a good deal of care and judgment.

It is, accordingly, an object of the present invention to provide a shim inserter for a slitting and re-rolling machine which is applicable to all machines of this type, both new machines and machines already in the field, to improve the safety thereof. It is a more specific object to provide an inserter which includes a strip reservoir, a strip guide remotely positioned and oriented, and a conveyor for forcibly ejecting the strips, one by one, into the nip of a loose coil of ribbon under remote control.

It is a further specific object of the present invention to provide a feeding assembly for shim stock having a tiltable frame mounted on a transversely movable carriage, the carriage being positioned under remote control with a selected ribbon and the frame being angled under remote control so that it is oriented with the nip of the selected ribbon.

It is a still further object of the invention in one of its aspects to provide a shim inserting device for a slitting and re-rolling machine in which a shim feeding assembly is mounted upon a transversely movable carriage and in which the carriage may be moved under remote control to a loose ribbon position automatically under the control of a selector switch with feeding of a shim strip being triggered also by remote control so that the re-rolled coils of ribbon resulting from the slitting operation may be wound into tight easily handled coils while the operator remains in a safe position at a control station.

It is, generally stated, an object to provide a shim inserter which may be easily and safely operateed under remote control, which is reliable, flexible in application and adjustment and which may be inexpensively manufactured and installed.

Other objects and advantages of the invention will become apparent upon reading the attached detailed description and upon reference to the drawings in which.

While the invention has been described in connection with a preferred embodiment, it will be understood that we do not intend to be limited to the particular embodiment shown but intend, on the contrary to cover the various alternative constructions included within the spirit and scope of the appended claims.

Figure 1:
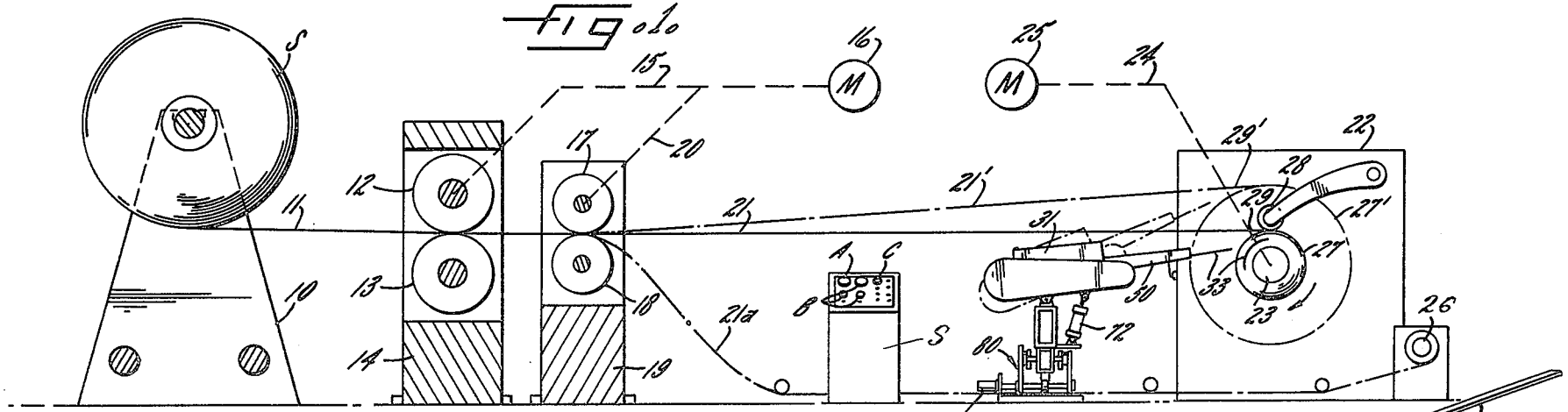
FIG. 1 is a general elevational view of a slitting and re-rolling machine employing a shim strip inserter constructed in accordance with the invention.
Figure 2:
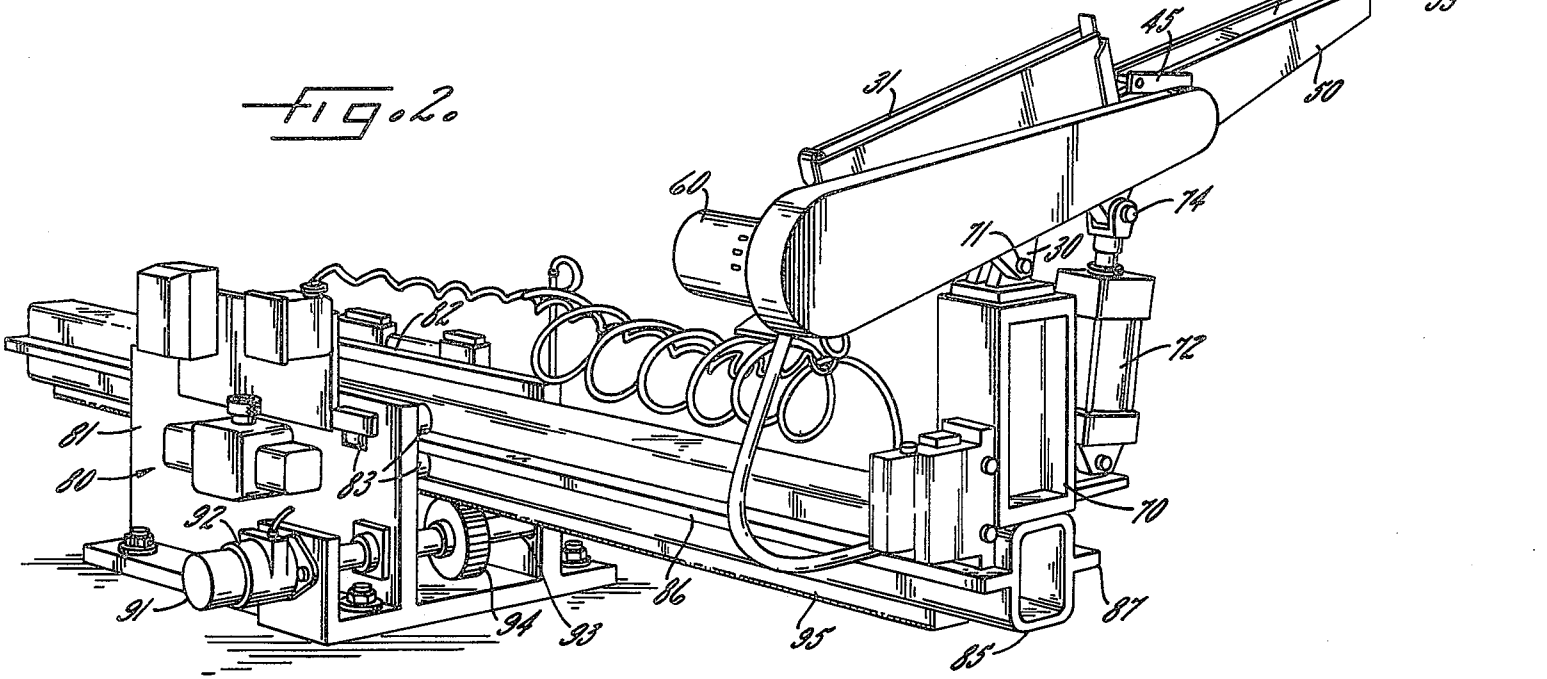
FIG. 2 is a perspective view of the inserter.

Turning now to FIG. 1 there is shown a typical slitting and re-rolling installation for converting a supply roll S into narrow ribbons of material having predetermined width. The roll S is mounted on a support 10 for feeding of a web 11. The web first passes through a pair of presser rolls 12, 13 mounted in a frame 14 and having a connection 15 to a drive motor 16.

From the presser rolls the web is fed into a set of rotary knives mounted on a top arbor 17 and bottom arbor 18, which are both mounted in a supporting frame 19, with a drive connection 20 to the motor 16. The ribbons resulting from the slitting operation, generally indicated at 21, pass horizontally to a re-roll stand 22. The re-roll stand has a mandrel 23 having a drive connection 24 to a re-roll drive motor 25 which may be of the torque type to provide constant take-up, or the motor may be conventional with a slightly over-driven clutch interposed. A typical re-rolled coil of ribbon is indicated at 27. Riding on the top of the coils is a separator roll 28 mounting a set of separator discs. As coiling progresses the size of the roll increases to produce a horizontal run 21' feeding a diameter 27', accompanied by movement of the nip from position 29 to position 29'.

The remote edges severed from the web, indicated at 21*a*, pass along the floor (see FIG. 1) and are wound as trim scrap upon a mandrel 26. Such mandrel also has a suitable over-driven slip clutch connection to a drive motor (not shown) for rolling up the scrap on a continuous basis.

In accordance with the present invention a shim inserter is provided under the horizontal run of the ribbons 21 including a feeding assembly having a reservoir for storing a supply of narrow shim strips and with an elevated strip guide projecting cantilever-fashion from the reservoir into the region of the nips 29, the assembly including a motor-driven conveyor for ejecting the strip through the guide, with adjustable tilting means for orienting the guide and with means for positioning the guide in register with a loose one of the ribbons, the entire device being operable from a control station which is safely spaced from the re-roll.

Thus referring to FIGS. 2–5 a frame 30 is provided mounting a reservoir box or hopper 31 having a front wall 32. The box 31 is of long narrow shape holding a stack of shims 33. The shims are preferably formed of 18-inch lengths of cheap self-supporting sheet material as, for example, common cardboard having a thickness in the range of 0.015 to 0.090 inch and a width from 1.25 to 6 inches. The stack of shims is pressed downwardly by a presser cover 34 which preferably bears against the front end of the stack.

For transporting the shims from the reservoir a conveyor belt 40 is provided under the stack, the belt being driven by a drive sheave 41 at its front, or discharge, end and supported by a plurality of sheaves 42 to insure that the top run of the belt is flat to provide a uniform frictional surface. The belt may, for example, be formed of rubber.

For the purpose of insuring that only a single shim is discharged at a time, the front wall 32 of the box 31 extends into rather close proximity with the belt to provide a discharge opening 43 having a vertical dimension sufficient to pass a single thickness of cardboard, the remainder of the stack being held back. A presser roller 44, cooperating with the drive sheave 41, and which is gravity biased upon an arm 45, bears against the top surface of the shim being conveyed from the reservoir and insures that the shim is propelled even after it is fully discharged from the reservoir.

After leaving the reservoir the shim is directed into a shim or strip guide 50 which is supported cantilever fashion upon the frame 30 and which is sufficiently thin, in its vertical dimension as to project into, or at least adjacent, the re-roll nip 29. The strip guide serves to confine the strip between a lower supporting surface 51 and an upper surface 52, with the strip being discharged at the front end 53 of the guide. A typical strip is shown at 33*a* in the act of being ejected from the guide. It is one of the features of the present invention that the distance between the end of the conveyor, indicated at 41, and the front end of the guide 53 is substantially less than the length of the strip so that the strip is forcibly ejected to a point well ahead of the front end of the guide to insure that the strip is captured in the nip.

For the purpose of driving the drive sheave 41 of the conveyor a motor 60 is provided on the frame 30 having a sprocket 61 which drives a chain 62 which is in turn trained about a sprocket 63 which is mounted upon the same shaft as the sheave 41, the chain and sprockets being enclosed by a guard 64. The sprocket 61 is, as shown, substantially larger than the sprocket 63 to provide a step-up driving ratio. In carrying out the invention the ratio is such that a single rotation of the sprocket 61 rotates the drive sheave 41 sufficiently to produce complete ejection of a shim strip. As will be discussed in connection with FIG. 7, this single revolution feature is utilized to produce automatic turn-off of the motor so that only a single strip is fed in response to manual actuation. The motor 60 may be either hydraulic or electric; however, an electric motor has been chosen to illustrate the control features.

For the purpose of mounting the feeding assembly for tilting movement and to register it in alinement with a loose ribbon 21, a carriage 70 is provided to which the frame 30 is tiltably secured by a pin 71. In order to control the degree of tilt to maintain the guide 50 oriented toward the nip progressively upon increase in the diameter of re-roll, an hydraulic actuator 72 is provided having a lower point of connection 73 to the carriage and an upper point of connection 74 to the frame of the feed assembly. The actuator is preferably of the double ended type with the hydraulic fluid being fed into one end and exhausted from the other to raise and lower. While it is preferred to employ an actuator 72, it will be understood that the invention is not limited thereto and any type of motor or power actuated device may be employed capable of controllably extending and contracting the distance between the points of connection 73, 74. Moreover, it will be understood that in the broader aspect of the present invention it is not necessary to rock the entire frame 30 to accommodate the device to increasing diameter of re-roll but, if desired, the strip guide 50 may have an articulated joint with respect to the frame 30, so as to make it capable of vertical swinging movement, in which case the upper point of connection 74 from the actuator may be connected directly to the guide. Indeed, it is contemplated that even an articulated connection may be dispensed with if the lower and upper members 51, 52 of the guide 50 are made of strips of flexible metal, thereby providing a variably curved path for the conveyed strips.

Figures 3, 6, 7, 9, 10, 11:
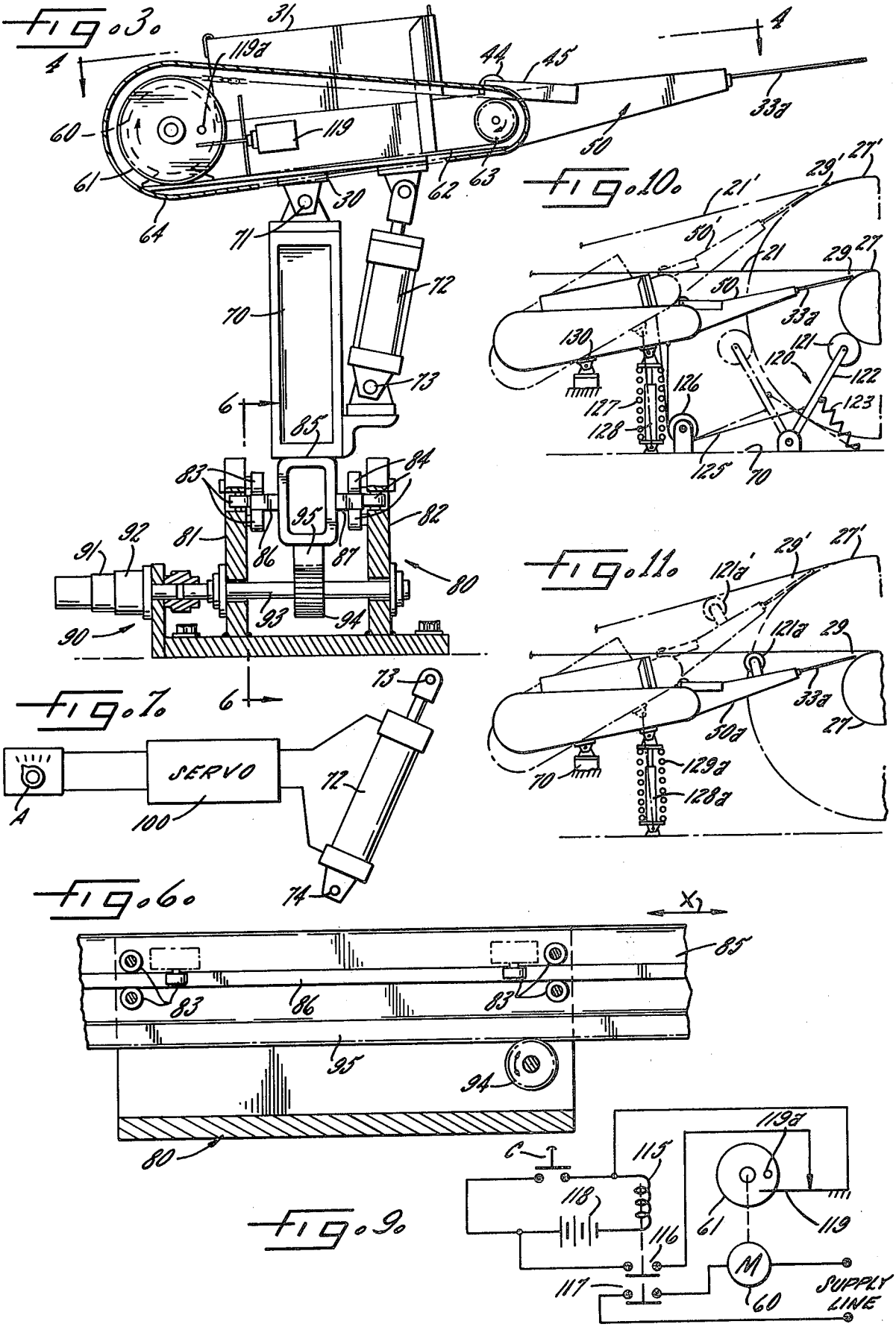
FIG. 3 is an elevational view of the shim inserter with the stationary and movable frames in partial section.
FIG. 6 is a vertical section looking along line 6—6 in FIG. 3.
FIG. 7 is a schematic circuit diagram showing means for controlling the tilt actuator.
FIG. 9 is a schematic diagram showing the means for cycling the feed motor.
FIG. 10 is a diagram showing a modification for securing constant automatic tilt adjustment.
FIG. 11 is a similar diagram showing a further modification.
Figure 4:
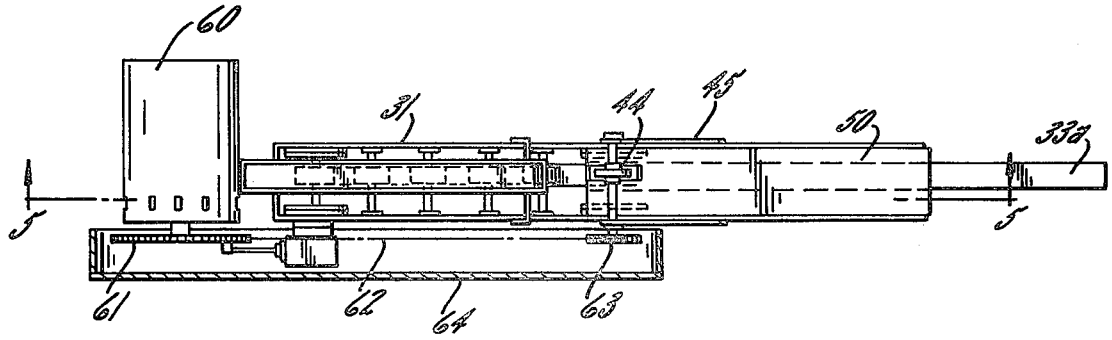
FIG. 4 is a fragmentary top view of the feeding assembly in partial section and looking along line 4—4 in FIG. 3.
Figure 5:
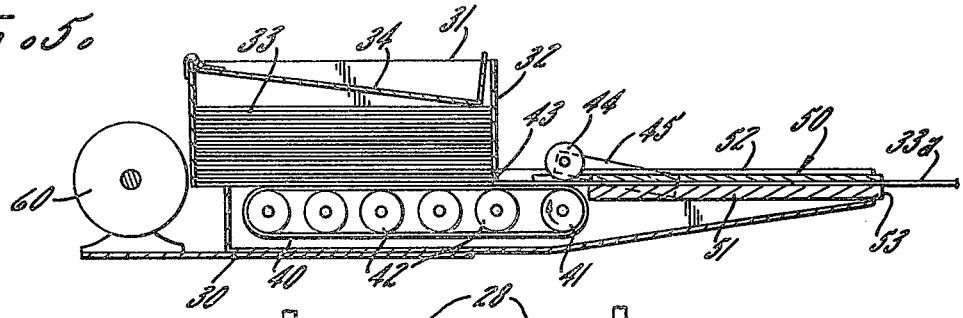
FIG. 5 is a vertical section taken through the feeding assembly along line 5—5 in FIG. 4.
Figure 8:
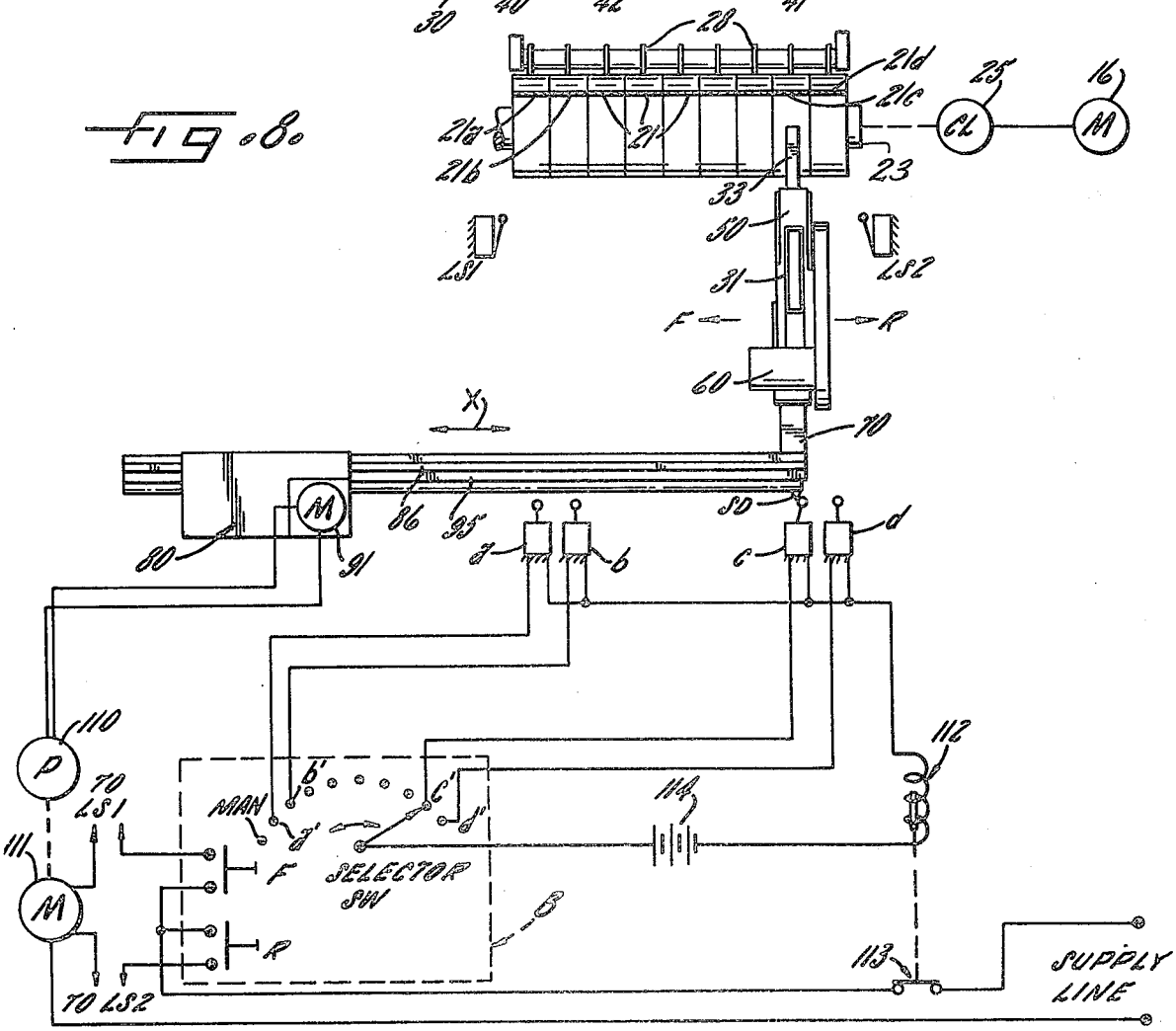
FIG. 8 is a schematic diagram showing means including a selector switch for automatic "homing" of the carriage in register with a selected ribbon.

In accordance with one aspect of the present invention, means are provided for moving the carriage 70 horizontally, and in a direction parallel to the nips 29, so as to selectively register the feeding assembly and its guide with respect to any desired one of the re-rolled ribbons, but most especially those ribbons in the end positions indicated at 21*a*–21*d* in FIG. 8. For mounting the carriage for translatory movement a stationary frame 80 is provided which is bolted or otherwise secured to the floor and which has parallel walls 81, 82 (see (FIG. 3). The stationary frame 18 is, as shown in FIG. 8, spaced axially off to one side of the re-roll mandrel 23. Mounted on the walls are sets of guide rollers 83, 84 respectively, two such sets being mounted in horizontally spaced positions. Mounted for reciprocation and cantilevered support in the guide rollers is a horizontally extending supporting arm 85 having way surfaces 86, 87, the carriage 70 being supported in overhanging position at the outer end of the arm. For driving the arm, that is, for determining the degree of extension, a driving mechanism 90 is provided including a motor 91, gear box 92, shaft 93 and pinion 94, the pinion meshing with a rack 95 which extends along the underside of the arm. It will be apparent that by driving the motor 91 in its opposite directions the carriage 70 and hence the strip guide 50 may be positioned in register with any one of the re-rolled ribbons. By placing the stationary frame 80 off to one side of the re-roll stand 22, and by supporting the inserter carriage 70 above the floor cantilever-fashion on the arm 85, the carriage may be freely moved to any inserting position without interference from the strips of trim scrap 21*a* and without interference from any other clutter which might be on the floor between the frames 14, 19, and the re-roll stand 22.

It is one of the features of the present construction that all of the control functions are remotely controlled from a control station S (FIG. 1) located at a safe distance from the re-roll operation, which is to be distinguished from the prior dangerous practice of manual insertion of shim strips. Thus there is provided in the station S a first control A which controls the tilt of the feeding assembly, a second control B for causing the carriage to move to a selected position of register and a control C in the form of a push button for initiating operation of the conveyor motor 60.

Referring first to the tilt control system shown in FIG. 7, the control A at the control station, which may be directly calibrated in terms of roll diameter, operates a servo 100 for feeding hydraulic fluid to the actuator 72. The details of the servo system 100 are not a part of the present invention. It will suffice to say that numerous servo systems are commercially available in which the degree of extension of a controlled actuator is directly settable on a control such as that illustrated at A. Since the angle of tilt of the guide need not be precise, it will suffice, in practical operation, for the operator of the machine to eye up the re-roll diameter and to maintain the control A set accordingly.

Turning next to control B, which adjusts carriage position, such control in its simplest aspects may consist of a simple pair of forward and reverse push buttons capable of driving the motor 91 in one direction or the other until the strip guide 50 is registered with a loose one of the webs. It is found that only a limited amount of skill is required in the operation of the control to locate the carriage in a registered position. However, to still further simplify operation of the machine it is one of the features of the invention that a "homing" type of control system is provided, under the control of a selector switch, and which is capable of causing the carriage to move automatically to a selected position and then stop without exercise of care or judgment on the part of the operator. Such a homing system is illustrated, by way of example, in FIG. 8. In this figure the motor 91, which is of the hydraulic type, is driven by a pump 110 which is in turn powered by an electric motor 111 having forward and reverse push buttons F, R. To secure the homing feature stationary switches of the limit switch type are spaced and arranged in the path of movement of a switch dog mounted on arm 85, or upon the carriage 70, so that the switches are actuated in the respective conditions of register of the strip guide. Thus we provide a series of switches *a, b, c, d* which are of the normally open type and which are closed upon being engaged by a switch dog SD mounted upon the arm. For activating a desired one of the switches *a–d* for homing purposes, a selector switch SS is provided having correspondingly lettered contacts $a^1$–$d^1$. The selector switch is connected in series with a relay 112 having normally closed contacts 113, with current for operating the relay being obtained from a suitable source of potential 114.

In operation, as long as the relay contacts 113 remain closed (as for example, when the selector switch is set in the illustrated "manual" position), the carriage motor 91 operates upon pressing either the forward or reverse push button. If looseness is noted in one of the ribbons, for example the ribbon 21*c*, the selector switch SS is moved to its $c^1$ position thereby connecting the limit switch *c* in series with the control relay 112. The appropriate push button is then pressed to drive the carriage in the direction of the offending ribbon. When the dog SD on the arm 85 strikes the switch *c* a circuit is completed to the relay, the relay contacts 113 open, and this automatically stops the motor with the feeding assembly in alinement with the web requiring the shim. Overtravel of the carriage in its respective directions is prevented by limit switches, indicated at LS1 and LS2, which are of the usual normally closed type connected in series with the respective push buttons.

To understand operation of control C of the control station, which controls the ejection, reference is made to FIG. 9. Interposed between the control C, which is in the form of a push button, is a relay 115 having set of contacts 116 and set of contacts 117. A suitable source of potential 118 is connected in the relay circuit.

Pressing the push button thus energizes the relay closing contacts 117 which are in series with the feed motor 60, which initiates operation of the conveyor so that a shim strip starts to feed through the guide 50. In accordance with the invention means are provided for insuring the forcible ejection of a single shim strip, and only one shim strip, each time the push button C is momentarily pressed. This action is brought about by employing the contacts 116 on the relay as sealing contacts and by connecting such contacts in series with a normally closed "wiping" type limit switch associated with the motor drive sprocket 61. Thus the limit switch, indicated at 119, has an actuating arm engaged by a pin or abutment 119*a* on the sprocket (see both FIGS. 3 and 9). Since the switch 119 is normally closed, the subsequent closure of the sealing contacts 116, when the push button is momentarily depressed, maintains the relay winding 115 energized so that the sprocket 61 undergoes a complete revolution. When the pin 119*a* on the sprocket strikes the switch actuator, the switch contacts 119 are opened, thus breaking the sealing circuit and permitting the relay to drop out thereby deenergizing the feed motor 60.

Thus by operating the controls A, B, C, in that order, at the control station a shim strip is inserted in a loose coil of ribbon easily, quickly and with entire safety.

It will be apparent to one skilled in the art that the invention is not limited to the particular control features shown, and the circuits may be simplified, or made more complete, as desired. For example, the switches *a, b, c* and *d*, used for "homing" purposes, may, instead, be connected to corresponding indicator lights, with lighting of one of the lights indicating that a reference condition of register has been achieved so that the push button which controls the carriage motor may be released. As a still simpler alternative, a bracket, mounted on the carriage and movable with it, may carry a pointer or spotlight to indicate a condition of register with a selected strip.

Also it is contemplated that changes may be made in the tilt controlling means without departing from the invention. If desired, the servo 100 shown in FIG. 7 may be omitted and the tilt actuator 72 may be directly controlled by a double throw valve. While this reduces the cost of the system, a certain amount of skill is required to manipulate the valve. On the other hand, to make the system more easily operated, and to eliminate the element of skill, and the attention which must be paid to the controls, means may be incorporated for automatically controlling tilt in accordance with the diameter of re-roll. Such automatic control may be carried out as diagrammatically illustrated in FIG. 10. As shown in this figure, a "feeler" 120 is provided for constant measurement of re-roll diameter. The feeler includes a resilient roller 121 mounted upon an arm 122 which is biased in the direction of the roll by a spring 123, the arm and spring both being mounted upon the carriage 70 for movement with it. For changing the angle of tilt in accordance with the position of the feeler, a connecting linkage, which in its simplest aspect may be in the form of a cable 125, is employed, the cable passing about an idler pulley 126. For supporting the overhanging weight of the frame 30 and the projecting guide 50, and for maintaining the cable taut, a compression type spring 127 is interposed between the frame 30 and the carriage, the spring being bypassed by a suitable shock absorber 128. In operation, then, when the re-roll diameter is small the feeler occupies its right-hand position pulling the frame 30 down to a relatively shallow angle against the force of biasing spring 127 so that an ejected strip 33*a* is in direct alinement with nip 29. As the re-roll diameter increases, the arm 122 progressively swings to the left, paying out the cable 125 and permitting the frame 130 to tilt upwardly under the urging of the spring 127 until the guide occupies a new position 50′ in which the ejected strip is alined with the new nip position 29′.

In the arrangement diagrammed in FIG. 10, the feeler roller 121 moves with the carriage. To facilitate this movement the roller 121 may be made of durable material, as for example, nylon, and may be provided with rounded ends. However, if desired, the roller 121 and the arm 122 upon which it is mounted may be relatively stationary, and the linkage which connects the arm to the frame 30 may include provision for relative lateral movement of the frame, a matter well within the skill of the art. If desired, the feeler roller 121 may be used to measure roller diameter by causing it to bear against the horizontal run of ribbons. Thus, as shown in simplified form in FIG. 11, where corresponding reference numerals are employed to denote corresponding parts, the roller 121*a* is mounted directly upon the guide 50*a* and follows the run of the ribbons upwardly, to increase the tilt of the strip guide progressively as the re-roll diameter increases.

While it is preferred to employ a reservoir for storing a stack of individual shim strips of predetermined length, as discussed, it will be understood by one skilled in the art that the term "reservoir" is not intended to require use of individual strips and the term, on the contrary, is to be interpreted to cover any source of strips, whether separated, or whether continuous, for example, in the form of a roll, and with an automatic cutter for severing the strip after the conveyor, or equivalent indexing means, has advanced a strip of predetermined length, which is, again; a matter well within the skill of the art.

In the above description it has been assumed, simply by way of example, that the original wide web is to be slit into nine ribbons of equal width. It will be understood that there is indeed no limitation upon the number of ribbons, nor the width of individual ribbons, the width and number being tailored to the customer's order. Where the number of ribbons is changed this, of course, changes the reference positions of register. Thus it is preferred that the switches *a*, *b*, *c* and *d*, shown in FIG. 8, be mounted in fixed, but adjustable, positions as necessary to aline them with the end coils of the re-roll. Such fixed but adjustable mounting is, of course, well within the skill of the art.

Moreover, while the invention has been described above in connection with a single feeding assembly mounted upon a movable carriage so as to be movable into reference positions of register, it will be understood that the invention may be practiced using more than one feed assembly, for example, a feed assembly at each end of the re-roll for servicing the respective end positions or, indeed, plural feed assemblies may be fixed in the end positions (although adjustably mounted) with provision at the control station for selective actuation as looseness may develop in the corresponding position.

The term "sprocket" as used herein will be understood to include a sheave where a belt, instead of chain, is used for a driving element. The term "motor" includes any type of motive device, normally electric or hydraulic. While the device is intended specifically for slitting and re-rolling of a continuous web of steel, it may be used with equal advantage in the slitting and re-rolling of other metals or materials in which the web is slightly "crowned" as a result of an original rolling operation resulting in a tendency toward looseness in the end coils of the series. The term "cantilever-fashion" refers to support above floor level so as not to be affected by trim scrap on the floor. What we claim is:

1. In a shim inserter for a slitting and re-rolling machine having a wide supply rool, a slitter therefor, and a driven take-up mandrel for re-rolling the resulting ribbons, with the take-up mandrel being spaced from the slitter to define a generally horizontal run of ribbons terminating in respective nips at the point of re-roll, the combination comprising a carriage, means for mounting the carriage under the horizontal run of ribbons for movement transversely with respect thereto, a frame tiltably mounted upon the carriage, a hopper on the frame for storing a vertical stack of narrow shim strips of predetermined length, a conveyor on the underside of the stack, a strip guide alined with the conveyor for receiving a conveyed strip and for ejecting the strip into the region of the nips, said conveyor being connected to a feed motor, power tilting means interposed between the carriage and the frame for tilting the frame to orient the guide in the direction of the adjacent nip progressively upon increase in the diameter of re-roll, means including a reversible motor for driving the carriage in opposite directions, and a control station located at a position safely remote from the nips and including (a) a first control connected to the power tilting means to adjust the angle of tilt of the frame in accordance with re-roll diameter, (b) a second control connected to the carriage motor to bring the carriage into a registered position with a selected loose one of the rewound ribbons and (c) a third control connected to the feed motor for ejection of a shim strip into the nip of the loose ribbon.

2. In a shim inserter for a slitting and re-rolling machine having a wide supply roll, a slitter for slitting the web from the supply roll into a number of ribbons plus lengths of trim scrap at the edges, and a driven take-up mandrel for re-rolling the resulting ribbons, with the take-up mandrel being spaced from the slitter to define a generally horizontal run of ribbons terminating at respective nips at the point of re-roll, the combination comprising a feeding assembly having a carriage and including a reservoir for storing a supply of narrow shim strips, an elevated strip guide projecting cantilever-fashion from the reservoir into the region of the nips, means including a feed motor and conveyor for feeding a shim strip from the reservoir and for ejecting the strip through the guide, adjustable tilting means for orienting the guide in the direction of the nips progressively upon increase in the diameter of re-roll, means for positioning the carriage in register with a loose one of the ribbons, remotely operated means for cycling the feed motor for feeding a shim strip into the nip of the loose ribbon, the carriage positioning means including a stationary frame axially offset with respect to the take-up mandrel and a supporting arm having transversely-extending way surfaces and projecting cantilever-fashion from the frame above floor level so that the carriage may be moved to any registering position free from obstruction by the trim scrap.

3. In a shim inserter for a slitting and re-rolling machine having a wide supply roll, a slitter therefor, and a driven take-up mandrel for re-rolling the resulting ribbons, with the take-up mandrel being spaced from the slitter to define a generally horizontal run of ribbons terminating at respective nips at the point of re-roll, the combination comprising a feeding assembly having a frame, a transversely movable carriage for mounting the frame with the frame being vertically tiltable with respect to the carriage, a hopper on the frame for storing a stack of shim strips of predetermined length, a strip guide projecting cantilever-fashion from the frame from one end of the stack of strips into the region of the nips, a longitudinal conveyor on the frame at the end of the stack of strips and having a feed motor so that when the motor is energized a strip is ejected through the guide, means for adjusting the angle of the frame with respect to the carriage upon increase in re-roll diameter so that the ejected strip is directed into the adjacent nip, and means including a carriage motor for positioning the carriage so that the guide is in register with a selected loose one of the ribbons, and manual means for cycling the feed motor.

4. The combination as claimed in claim 3 in which the shim strips are sufficiently stiff as to be self-supporting and in which the discharge end of the conveyor means extends sufficiently close to the end of the guide so that the ejected strip is forcibly projected beyond the end of the guide and into the nip.

5. In a shim inserter for a slitting and re-rolling machine having a wide supply roll, a slitter, and a driven take-up mandrel for re-rolling the resulting ribbins, with the take-up mandrel being spaced from the slitter to define a generally horizontal run of ribbons terminating at respective nips at the point of re-roll, the combination comprising a feeding assembly having a hopper for storing a vertical stack of narrow shim strips of predetermined length, an elevated strip guide projecting cantilever-fashion from the reservoir into the region of the nips, means including a feed motor and conveyor for feeding a shim strip from the stack and for ejecting the strip through the guide, adjustable tilting means for orienting the guide in the direction of the nips progressively upon increase in the diameter of the re-roll, means for positioning the feeding assembly in register with a loose one of the ribbons, and remotely operated means for cycling the motor for feeding a shim strip into the nip of the loose ribbon, the conveyor including a frictional belt trained about a series of sheaves, the sheaves being drivingly connected to the feed motor, and the discharge end of the conveyor being sufficiently close to the end of the guide so that a shim strip is ejected from the guide forcibly into the nip.

6. The combination as claimed in claim 5 in which means are provided for manually initiating operation of the motor as well as means automatically turning off the motor incident to ejection of a single shim strip through the guide.

7. The combination as claimed in claim 6 in which the automatic turn-off means includes a limit switch for breaking the motor circuit upon predetermined movement of the conveyor.

8. In a shim inserter for a slitting and re-rolling machine having a wide supply roll, a slitter therefor, and a driven take-up mandrel for re-rolling the resulting ribbons, with the take-up mandrel being spaced from the slitter to define a generally horizontal run of ribbons terminating at respective nips at the point of re-roll, the combination comprising a feeding assembly having a frame, a reservoir box containing a stack of shim strips of predetermined length, an endless frictional conveyor belt extending under the box and mounted upon spaced sheaves, a motor for driving the belt, the front end of the box having limited clearance with respect to the belt to define an outlet opening capable of passing only a single shim strip at a time with the adjacent strips being withheld, a longitudinal strip guide alined with the outlet opening and projecting cantilever-fashion from the frame into the region of the nips, the shim strips being sufficiently stiff as to be self-supporting and the conveyor belt extending sufficiently close to the end of the strip guide that the conveyor is effective to forcibly project a shim strip into engagement with the adjacent nip, a carriage for tiltably supporting the frame in a position in which the strip guide is oriented in the direction of the nip, means for positioning the carriage in a position in which the guide is registeringly alined with a loose one of the ribbons, and means for cycling the motor for feeding of a shim strip into the nip of the loose ribbon.

9. The combination as claimed in claim 8 in which the conveyor belt extends forwardly of the front wall of the box and in which a presser roller is provided above the front end of the conveyor belt to hold the ejected strip in contact with the conveyor belt after it leaves the reservoir box.

10. The combination as claimed in claim 8 in which the motor is mounted at the rear of the reservoir box, the motor having means including a drive sprocket for driving the belt, the drive sprocket being of such size that a single revolution of the drive sprocket suffices to cause a shim strip to be forcibly ejected from the strip guide by the conveyor belt, the motor having a manually operated switch for initiating motion thereof, and means including a limit switch responsive to a single rotation of the drive sprocket for turning off the motor.

11. In a shim inserter for a slitting and re-rolling machine having a wide supply roll, a slitter therefor, and a driven take-up mandrel for re-rolling the resulting ribbons, with the take-up mandrel being spaced from the slitter to define a generally horizontal run of ribbons terminating at respective nips at the point of re-roll, the combination comprising a feeding assembly having a reservoir for storing a supply of narrow shim strips, an elevated strip guide projecting cantilever-fashion from the reservoir into the region of the nips, means including a feed motor for feeding a strip from the reservoir and for ejecting the strip forcibly through the guide, adjustable tilting means for orienting the guide in the direction of the nips progressively upon increase in the diameter of re-roll, a stationary frame axially offset with respect to the take-up mandrel, a supporting arm on the stationary frame projecting horizontally therefrom above floor level and parallel to the nips, a carriage at the end of the supporting arm for supporting the feeding assembly for transverse movement parallel to the nips so that the feeding assembly may be registered with a selected one of the ribbons, a motor on the stationary frame and drivingly coupled to the supporting arm for positioning the carriage, control means for the carriage motor causing the carriage to be driven in opposite directions to establish a condition of registered alinement between the guide and a loose one of the ribbons, and means for initiating operation of the feed motor when the guide is in its alined condition.

12. In a shim inserter for a slitting and re-rolling machine having a wide supply roll, a slitter therefor, and a driven take-up mandrel for re-rolling the resulting ribbons, with the take-up mandrel being spaced from the slitter to define a generally horizontal run of ribbons terminating at respective nips at the point of re-roll, the combination comprising a carriage, stationary frame structure including transversely directed ways for guiding the carriage along a path of transverse movement parallel to the nips of the re-rolled ribbons, a feeding assembly mounted on the carriage including a reservoir for storing a supply of narrow shim strips, an elevated strip guide projecting from the reservoir to the region of the nips, a conveyor for conveying a strip from the reservoir and for ejecting the strip from the guide, a feed motor for driving the conveyor, means interposed between the carriage and the guide for changing the angle of tilt of the guide so that the ejected shim strip is oriented in the direction of the adjacent nip for capture by the ribbon, means including limit switches defining a plurality of reference carriage positions in which the carriage is registered with respect to the respective ribbons, and a control station located remotely from the nips including (a) means including a selector switch having contacts connected to the limit switches for causing the carriage to home automatically to the reference position corresponding to a selected loose ribbon requiring shimming and (b) means for initiating rotation of the feed motor for ejection of a shim strip from the guide into the nip of the loose ribbon.

* * * * *